US006931974B2

(12) United States Patent
Tseng

(10) Patent No.: US 6,931,974 B2
(45) Date of Patent: Aug. 23, 2005

(54) CUTTING APPARATUS

(75) Inventor: Tzu-Feng Tseng, Taipei (TW)

(73) Assignee: Primax Electronics, Ltd. (TW)

( * ) Notice: Subject to any disclaimer, the term of this patent is extended or adjusted under 35 U.S.C. 154(b) by 0 days.

(21) Appl. No.: 10/705,616

(22) Filed: Nov. 10, 2003

(65) Prior Publication Data

US 2004/0098867 A1 May 27, 2004

Related U.S. Application Data

(63) Continuation-in-part of application No. 10/244,776, filed on Sep. 16, 2002.

(30) Foreign Application Priority Data

May 1, 2003 (TW) ..... 92112059 A

(51) Int. Cl.[7] ..... B26D 5/10; B26D 7/26

(52) U.S. Cl. ..... 83/699.11; 83/582; 83/614; 83/620

(58) Field of Search ..... 83/614, 620, 582, 83/699.11, 699.21, 699.51, 699.61

(56) References Cited

U.S. PATENT DOCUMENTS

| | | | |
|---|---|---|---|
| 4,046,044 | A | 9/1977 | Paterson et al. |
| 5,322,001 | A | 6/1994 | Boda |
| 5,671,647 | A | 9/1997 | Mori |
| 5,802,942 | A | 9/1998 | Cornell et al. |
| 5,819,618 | A | 10/1998 | Rodriguez |
| 6,098,515 | A | 8/2000 | Daley, Jr. |
| 6,209,434 | B1 | 4/2001 | Kim et al. |
| 6,460,443 | B1 | 10/2002 | Hsiao |
| 2003/0029291 | A1 | 2/2003 | Lin |

FOREIGN PATENT DOCUMENTS

| | | |
|---|---|---|
| GB | 1141951 | 2/1969 |

*Primary Examiner*—Charles Goodman
(74) *Attorney, Agent, or Firm*—Madson & Metcalf

(57) ABSTRACT

A cutting apparatus for cutting a sheet material is provided. The cutting apparatus includes a platform; a rail structure secured onto the platform; a sliding member sliding along the rail structure; a cutting member movably engaging with and carried by the sliding member to pass through and cut the sheet material sustained on the platform; and an adjusting member. The adjusting member can urge the cutting member to move relative to the sliding member so as to contact with the sheet material in response to an external force, and return the cutting member to move relative to the sliding member so as to release the cut sheet material manually or automatically.

19 Claims, 5 Drawing Sheets

CUTTING APPARATUS

CROSS REFERENCE TO RELATED PATENT APPLICATION

This patent application is a continuation-in-part (CIP) of a U.S. patent application Ser. No. 10/244,776 filed Sep. 16, 2002, and now pending. The content of the related patent application is incorporated herein for reference.

FIELD OF THE INVENTION

The present invention relates to a cutting apparatus, and more particularly to a cutting apparatus for cutting papers.

BACKGROUND OF THE INVENTION

Please refer to FIG. 1 which is a schematic diagram showing the appearance of the conventional cutting apparatus. The cutting apparatus 10 includes a rail 11 and a slider 12. The slider 12 is secured thereonto a cutting element such as a blade (not shown) and carries the cutting element to slide along the rail 11. After one or more pieces of paper to be cut are placed in the space 111 under the slider 12, the slider 12 is pressed down to have the blade sustain against the paper to be cut. The pressed slider 12 moves to and fro along the rail 11, thereby driving the cutting element to pass through and cut the paper.

Based on the structure of the conventional cutting apparatus, the user has to depress the slider 12 to urge the cutting member downwards to contact with the paper. The downward urging force results in an increased friction force between the slider 12 and the rail 11. Hence, the increased friction force hinders the user from moving the slider 12 along the rail 11 smoothly to cut the paper. Accordingly, it is laborious to use such cutting apparatus.

Therefore, the purpose of the present invention is to develop a labor-saving cutting apparatus to deal with the above situations encountered in the prior art.

SUMMARY OF THE INVENTION

An object of the present invention is to provide a labor-saving cutting apparatus for easily cutting sheet material.

Another object of the present invention is to provide a blade carriage for use with a cutting apparatus to cut sheet material in a labor-saving manner.

According to the present invention, there is provided a cutting apparatus, comprising: a platform for sustaining thereon the sheet material to be cut; a rail structure secured onto the platform; a sliding member disposed on and movable along the rail structure; a cutting member movably engaging with and carried by the sliding member to pass through and cut the sheet material sustained on the platform; and an adjusting member urging the cutting member to move relative to the sliding member so as to contact with the sheet material in response to a first external force status and returning the cutting member to move relative to the sliding member so as to release the cut sheet material in response to a second external force status.

Preferably, the adjusting member includes: a knob for receiving an external force in either the first external force status or the second external force status; and a sustaining member mounted in the knob and having a thicker portion and a thinner portion. The thicker portion is used to urge the cutting member to move downwards in the first external force status, and the thinner portion is used to provide a space thereunder for the cutting member to retract in the second external force status.

Preferably, the external force applied on the knob is a rotating force.

In an embodiment, the first external force status is the exertion of the rotating force in clockwise direction or counterclockwise direction, while the second external force status is the exertion of the rotating force in the opposite direction.

In another embodiment, the first external force status is the exertion of the rotating force, and the second external force status is the release of the rotating force.

Certainly, the adjusting member further includes an elastic member interfacing between the knob and the sliding member for returning the knob to an initial position when there is no external force exerted. Preferably, the elastic member is a torsion spring.

In an embodiment, the sustaining member includes a pair of sustaining blocks disposed symmetrically and oppositely. Each of the sustaining blocks has an intermediate peak portion and two lateral incline portions.

Preferably, the cutting member includes: a rotary knife for completely cutting the sheet material; a holding element holding the rotary knife and sustained by the intermediate peak portions of the sustaining blocks to move downwards so as to make the rotary knife protrude from a slot of the sliding member in the first external force status; a resilient member engaging with the holding element and sustaining against the sliding member adjacent to the slot to push the rotary knife to retract into the sliding member in the second external force status.

In another embodiment, the cutting member includes three cutting portions arranged in series, including: a first blade having a sharp portion for making the sheet material have a complete cut line while moving cross the sheet material; a second blade having a gear-shaped blade including sharp teeth at an equidistant interval for making the sheet material have an intermittent cut line while rolling cross the sheet material; and a third blade having a blunt portion for making the sheet material to have a folding line while moving cross the sheet material.

Certainly, the sustaining member includes: a first sustaining element located at one side of the knob, and having a rising incline ending at a first peak in a specific direction; a second sustaining element disposed at the opposite side of the knob, and having a falling incline beginning with a second peak in the same direction; and a third sustaining element consisting of a pair of sustaining blocks symmetrically disposed between the first and second sustaining elements, each of the sustaining blocks having an intermediate peak portion and two lateral incline portions. The positions of the first peak of the first sustaining element, the second peak of the second sustaining element, and the peak portions of the third sustaining element are arranged to respectively sustain the cutting portions of the cutting member at different time points while rotating the knob, thereby pushing essentially one of the cutting portions downwards at one time in response to the first external force status.

According to another aspect of the present invention, there is provided a carriage for use with a cutting apparatus for carrying a cutting member to cross over the sheet material. The carriage includes: a knob having a sustaining member therein for receiving a rotating force; a coupling member having a slot and cooperating with the knob to define a receptacle for accommodating therein the cutting member; and an elastic member interfacing between the knob and the coupling member for returning the knob to an initial position when the rotating force is released. The cutting member is urged by the sustaining member to protrude from the slot to contact with the sheet material in response to the rotating force and retracted into the coupling member when the knob is returned to the initial position.

According to a further aspect of the present invention, there is provided a cutting apparatus, comprising: a platform for sustaining thereon the sheet material; a rail structure secured onto the platform; a sliding member disposed on and movable along the rail structure; a cutting member movably engaging with and carried by the sliding member to pass through and cut the sheet material sustained on the platform; a knob cooperating with the sliding member and having a sustaining member therein for receiving a rotating force to rotate from an initial position to a working position; and an elastic member interfacing between the knob and the sliding member for returning the knob to the initial position when the rotating force is released.

BRIEF DESCRIPTION OF THE DRAWINGS

The present invention may best be understood through the following description with reference to the accompanying drawings, in which:

FIG. 3(*b*) is an explosive view illustrating an inner structure of the carriage of FIG. 2 according to another preferred embodiment of the present invention.

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
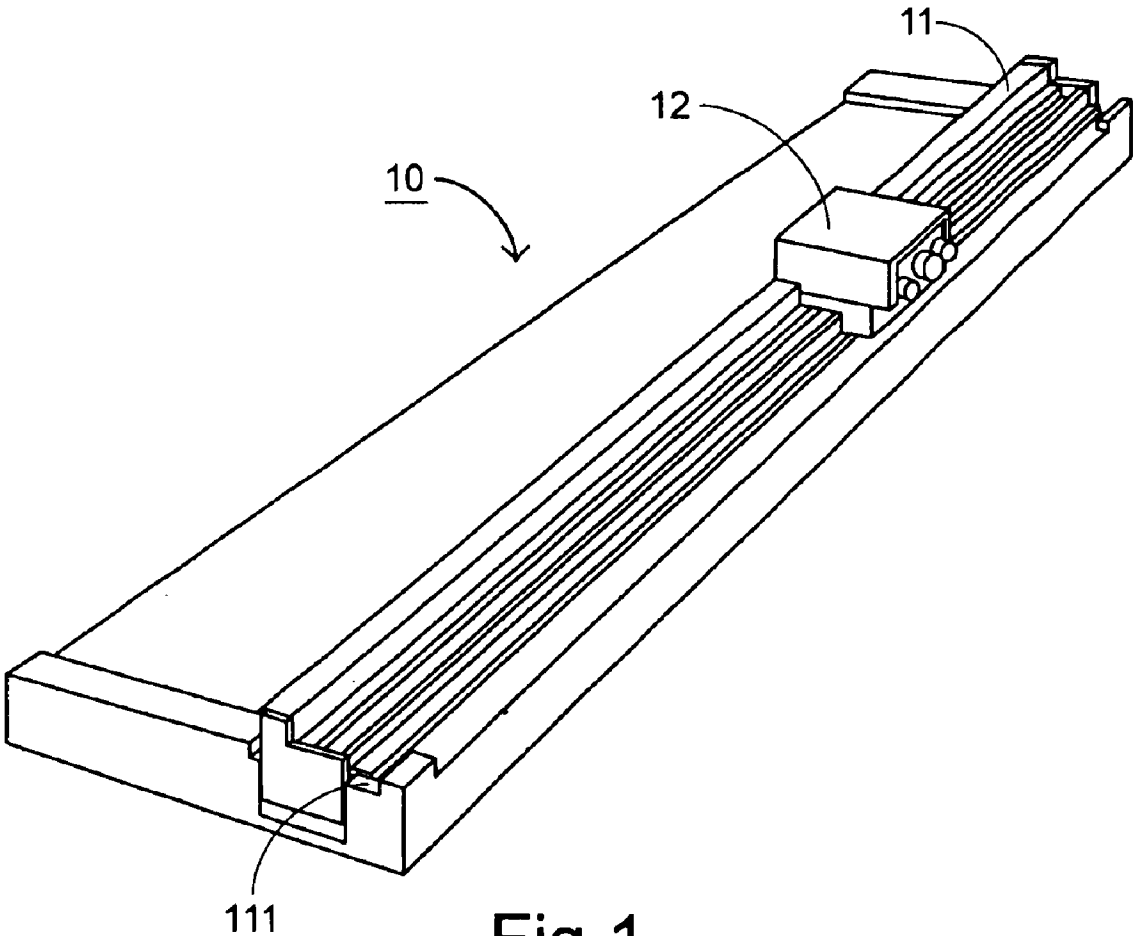
Fig.1 PRIOR ART
FIG. 1 is a perspective diagram illustrating the appearance of a conventional cutting apparatus.
Figure 2:
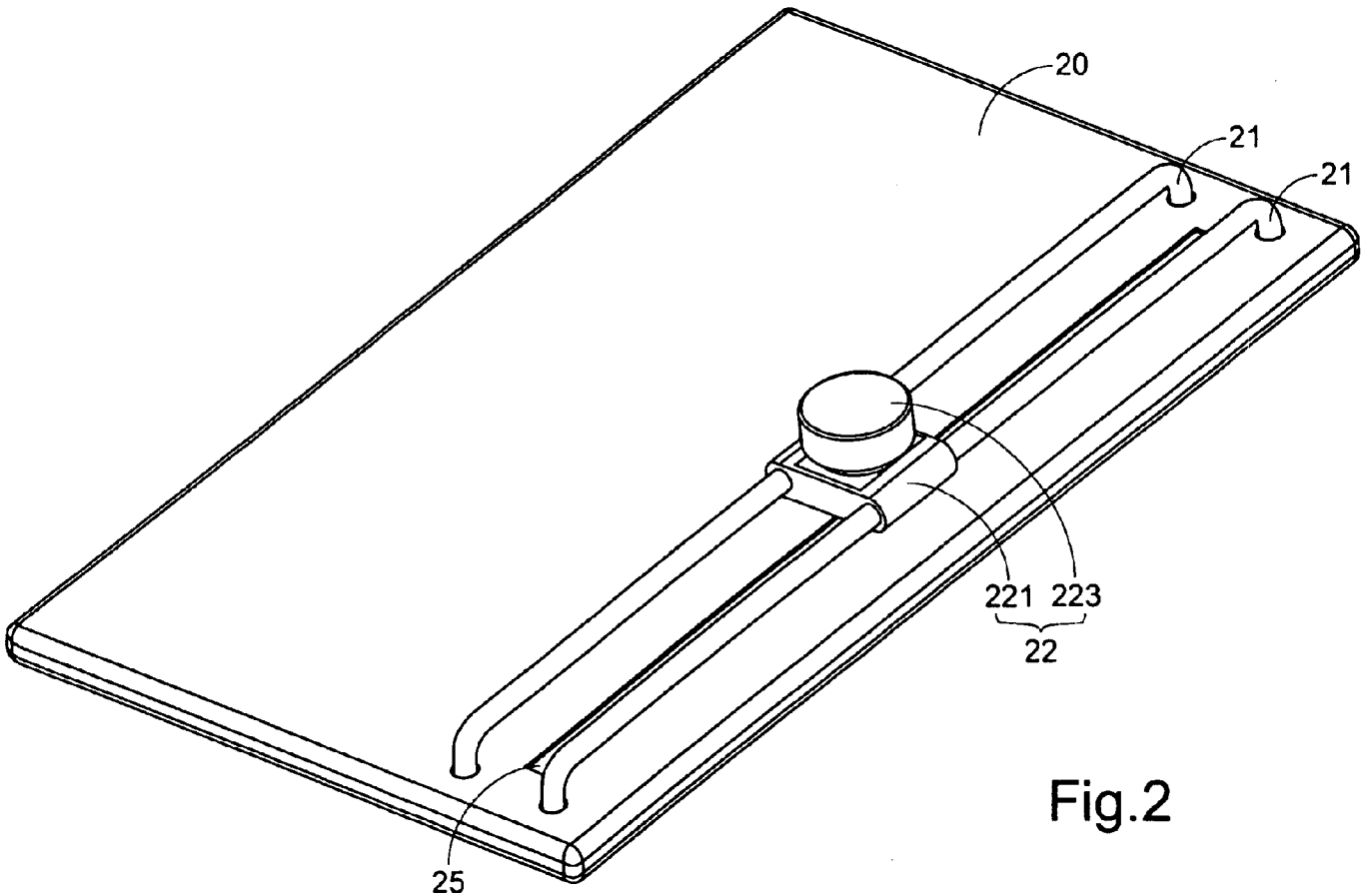
FIG. 2 is a perspective diagram illustrating the appearance of a cutting apparatus according to the present invention.

Please refer to FIG. 2 which is a perspective diagram illustrating the appearance of a cutting apparatus according to the present invention. The cutting apparatus mainly includes a platform 20, a rail structure 21, and a carriage 22 accommodating therein a cutting member such as a blade (not shown in this figure). The platform 30 is used to place one or more pieces of paper thereon. There is a cutting pad 25 on the platform 20 on which the portion of the paper to be cut open is positioned. The rail structure 21 includes two tracking bars secured onto the platform 20. The carriage 22 includes a sliding member 221 and a knob 223. The sliding member 221 has two through holes on the lateral sides for passing therethrough the two tracking bars 21. The knob 223 is mounted on and rotatable about the sliding member 221. By rotating the knob 223, the cutting member therein protrudes from the sliding member 221 to reach the paper on the pad 25. The movement of the sliding member 221 carries the knob 223 to move along the tracking bars 21 and simultaneously carries the exposed cutting member to move on the pad 25 to cut the paper.

Figure 3A:
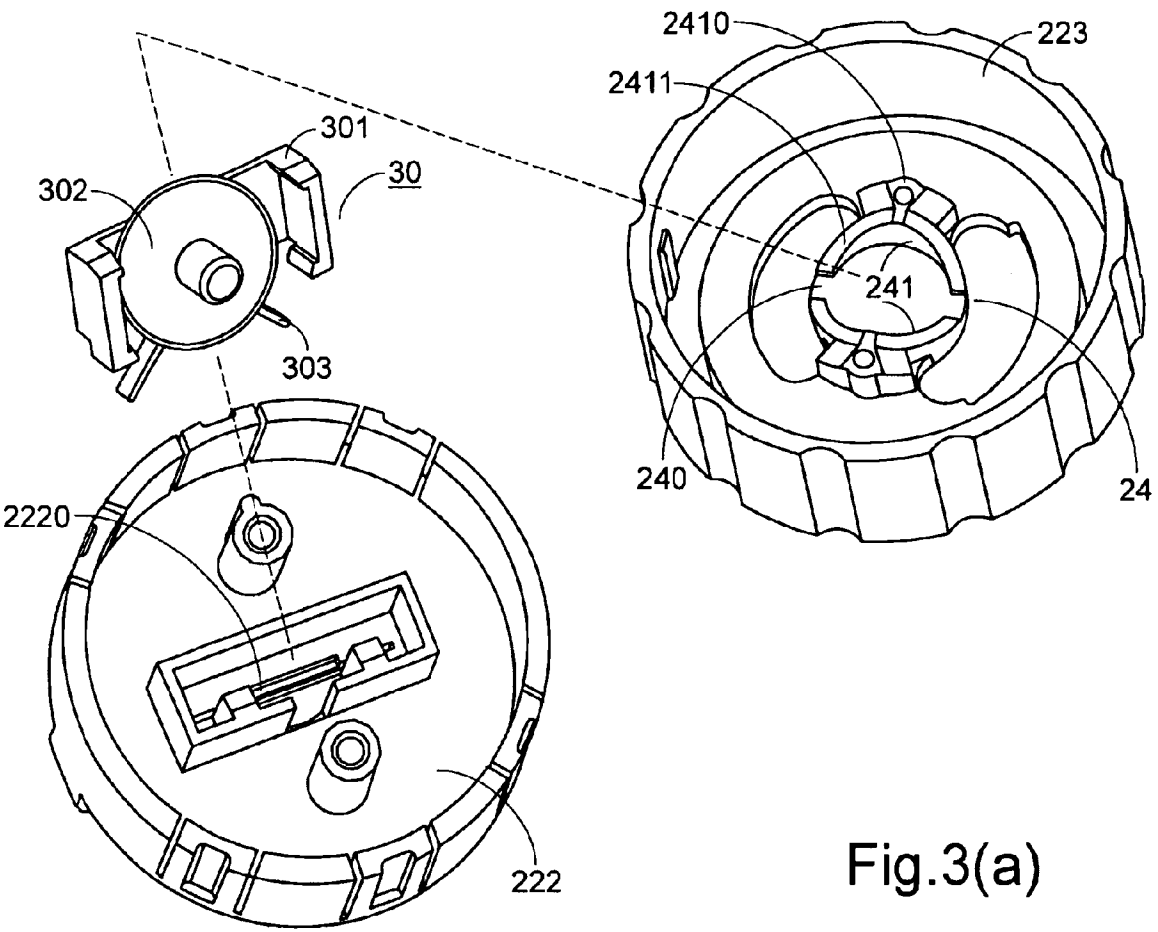
FIG. 3(*a*) is an explosive view illustrating an inner structure of the carriage of FIG. 2 according to a preferred embodiment of the present invention.
Figure 3B:
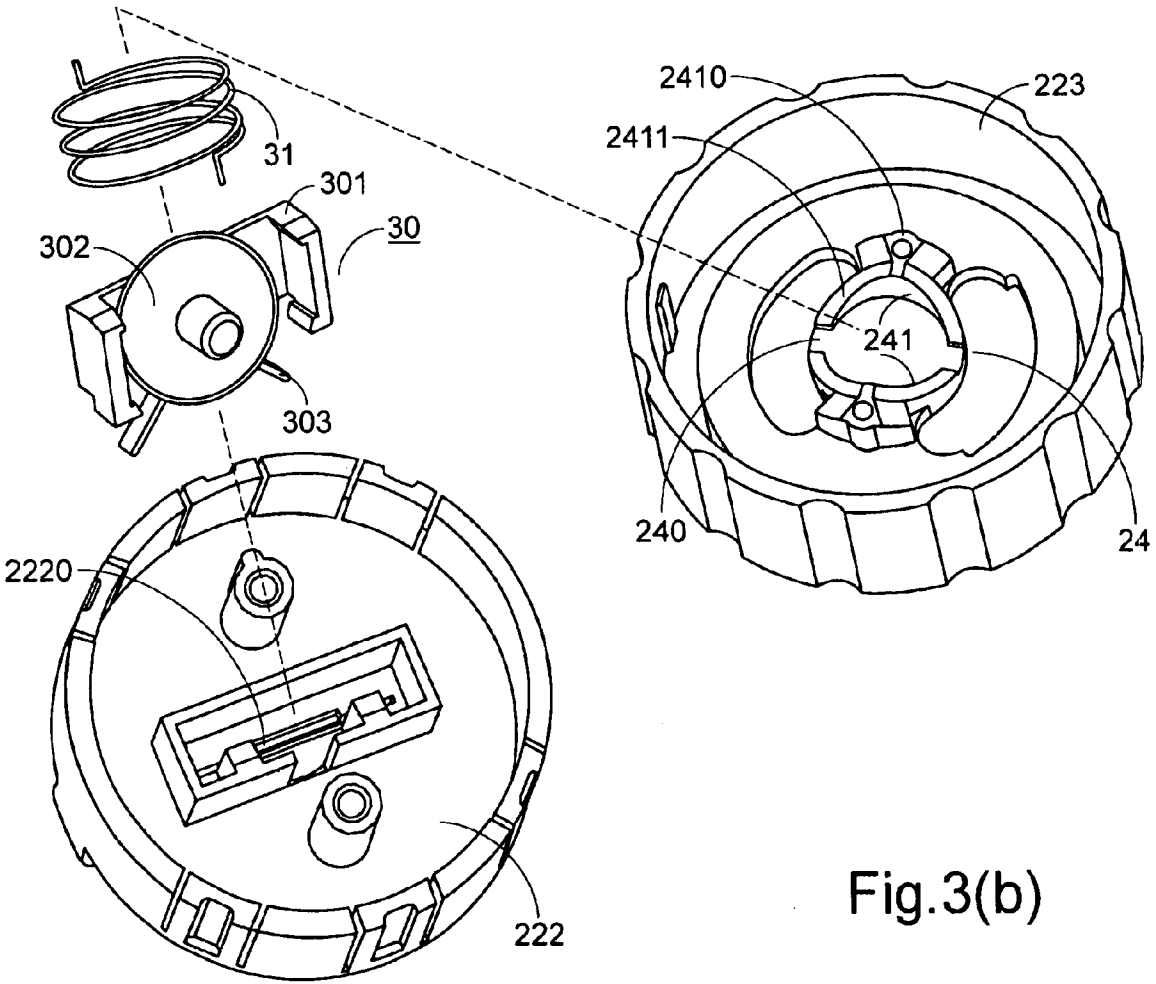

Please refer to FIG. 3(*a*). The inner structure of the carriage 22 and the cutting member mounted inside the carriage 22 according to a preferred embodiment of the present invention are illustrated. The knob 223 has a sustaining member 24 on the inner surface. The sustaining member 24 includes a pair of sustaining blocks 241 disposed symmetrically and oppositely at the central position on the inner surface of the knob 223. Each of the sustaining blocks 241 has an intermediate peak portion 2410 (thicker portion) and two lateral incline portions 2411 (thinner portion).

The cutting member 30 includes a holding element 301, a cutting tool such as a rotary knife 302, and two resilient pieces 303. The rotary knife 302 is rotatably sleeved on an axle of the holding element 301, and the resilient pieces 303 are secured to the lower portion of the holding element 301. The carriage 22 further comprises a coupling member 222 secured on the sliding member 221 and covered by the knob 223. The cutting member 30 is clamped between the coupling member 222 and the knob 223 with the two resilient pieces 303 sustaining against the inner bottom surface of the coupling member 222. There is a slot 2220 on the bottom surface of the coupling member 222 for allowing the rotary knife 302 to expose therefrom in response to the rotating operation of the knob 223.

The operation of the cutting apparatus will be illustrated hereinafter with reference to FIG. 2 and FIG. 3(*a*). The holding element 301 contacts with the empty sites 240 between the sustaining blocks 241 when the cutting apparatus is not in use. When the knob 223 is exerted thereon a rotating force to rotate by quarter cycle relative to the coupling member 222 clockwise or counterclockwise, the holding element 301 of the cutting member 30 "climbs up" the lateral incline portions 2411 to reach the intermediate peak portions 2410. Consequently, the holding element 301 is pushed by the intermediate peak portions 2410 following the lateral incline portions 2411. By this way, the rotary knife 302 protrudes from the slot 2220 to cut paper. Meanwhile, the resilient pieces 303 further urge against the bottom surface of the coupling member 222 and is slightly distorted due to the downward motion of the holding element 301.

After finishing cutting action, the knob 223 is rotated by a further quarter cycle or rotated back by the quarter cycle relative to the coupling member 222. Accordingly, the holding element 301 "goes down" along the lateral incline portion 2411 to leave more vacancy for the holding element 301. The presence of the vacancy allows the upward movement of the holding element 301 in response to the recovery force of the distorted resilient pieces 303 so that the rotary knife 302 is carried by the holding element 301 to be retracted into the housing of the coupling member 222.

Please refer to FIG. 3(*b*), in which the inner structure of a carriage according to another embodiment of the present invention is illustrated. The elements included in the carriage are the same as those shown in and described with reference to FIG. 3(*a*) except that an elastic member such as a torsion spring 31 is additionally provided to interface between the knob 223 and the coupling member 222. When the knob 223 is rotated by quarter cycle relative to the coupling member 222 in either the clockwise direction or the counterclockwise direction, the torsion spring 31 is also distorted. Once the rotating force exerted on the knob 223 is released, the torsion spring 31 will recover from the distorted status. That is, the knob 223 is rotated by the quarter cycle relative to the housing 222 in the opposite direction to return to its initial position. Hence, contrary to the description in the forgoing paragraph, the rotary knife 302 is retracted into the housing 222 automatically without the exertion of an opposite rotating force on the knob 223.

Figure 4:
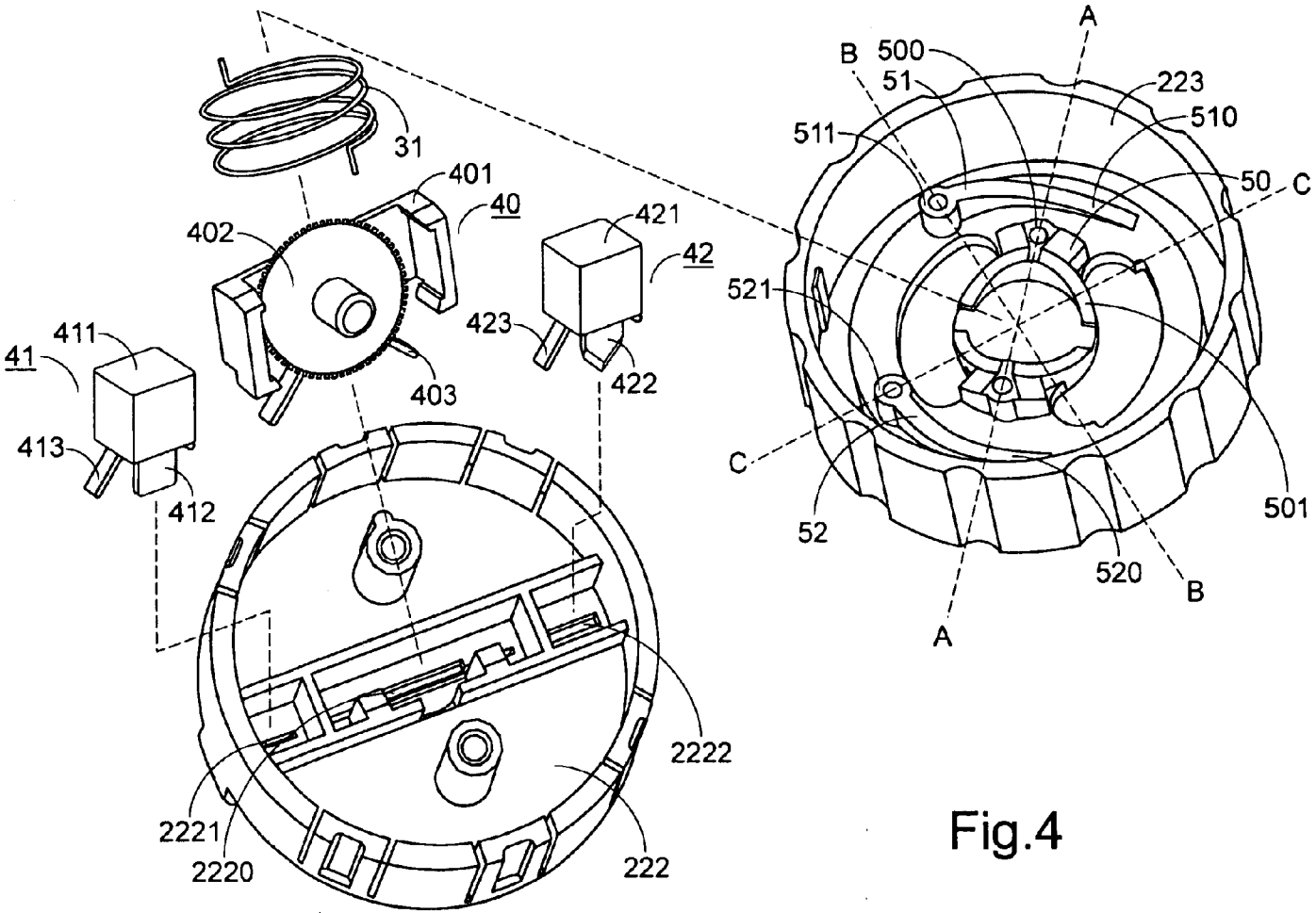
FIG. 4 is an explosive view illustrating an inner structure of the carriage of FIG. 2 according to a further preferred embodiment of the present invention.

Please refer to FIG. 4, in which the inner structure of a carriage of a multifunctional cutter according to a further embodiment of the present invention is illustrated. The multifunctional cutter includes three kinds of cutting members 40, 41, and 42 for cutting paper or similar material in different ways. The first cutting member 40 includes a holding element 401, a gear-shaped rotary knife 402, and two resilient pieces 403. The gear-shaped rotary knife 402 includes teeth portions arranged at an equidistant interval to be in contact with the cut paper. The second cutting member 41 includes a holding element 411, a blunt blade 412, and two resilient pieces 413. Similarly, the third cutting member 42 includes a holding element 421, a sharp blade 422, and two resilient pieces 423. Certainly, there are three slots 2220, 2221, and 2222 disposed on the housing 222 for penetrating therethrough the gear-shaped rotary knife 402, the blunt blade 412, and the sharp blade 422 respectively.

In this preferred embodiment, the sustaining member on the knob 223 has three sustaining elements, including the first sustaining element, the second sustaining element 51, and the third sustaining element 52. The first sustaining element has a pair of sustaining blocks 50 disposed symmetrically and oppositely at the central position on the inner surface of the knob 223. Each of the sustaining blocks 50 has an intermediate peak portion 500 and two lateral incline portions 501. The second sustaining element 51 has a rising incline 510 ending at a peak 511 in the counterclockwise direction, while the third sustaining element 52 has a falling incline 520 beginning with a peak 521 in the same direction. The second sustaining element 51 and the third sustaining element 52 are located at the opposite sides of the first sustaining element.

In order to form on the paper with an intermittent cut line, the knob 223 receives a rotating force to rotate relative to the coupling member 222 to have the second holding element 411, the first holding element 401, and the third holding element 421 be aligned along the line A—A. The first holding element 401 "climbs up" the lateral incline portions 501 to reach the intermediate peak portions 500. Hence, the gear-shaped rotary knife 402 is pushed downwards to be partially exposed from the slot 2220. At this moment, the second holding element 411 and the third holding element 421 are located at the middle positions of the incline 510 of the second sustaining element 51 and the incline 520 of the third sustaining element 52. Hence the blunt blade 412 and the sharp blade 422 stay inside the housing of the coupling member 222. In addition, the resilient pieces 403 are distorted. The gear-shaped rotary knife 402 is carried by the carriage 22 to move along the tracking bars 21 to have the protruding portion of the gear-shaped rotary knife 402 pass through the paper to be cut. Therefore, the paper has an intermittent cut line thereon.

Alternatively, for adding a folding line on paper, the user exerts a rotating force on the knob 223 until the holding elements 401, 411, and 421 are aligned along the line B—B. Since the second holding element 411 "climbs up" the rising incline 510 to reach the peak 511, the blunt blade 412 is extruded to partially expose from the slot 2221. At this moment, the first holding element 401 and the third holding element 421 are located at the middle positions of the lateral incline portions 501 of the sustaining blocks 50 and the incline 520 of the third sustaining element 52. Hence, the gear-shaped rotary knife 402 and the sharp blade 422 stay inside the housing of the coupling member 222. Likewise, the resilient pieces 413 are distorted. The blunt blade 412 is carried by the carriage 22 to move along the tracking bars 21 to have the protruding portion of the blunt blade 412 pass through the paper. Therefore, the paper has a folding line thereon.

In another case that the user wants to cut the paper into two pieces, the knob 223 receives a rotating force from the user to rotate relative to the coupling member 222 so as to align the holding elements 401, 411, and 421 along the line C—C. The third holding element 421 "climbs up" the incline 520 to reach the peak 521. Hence, the sharp blade 412 is partially exposed from the slot 2222 due to the extrusion of the peak 521. At this moment, the first holding element 401 and the second holding element 411 are located at the middle positions of the lateral incline portions 501 of the sustaining blocks 50 and the incline 510 of the second sustaining element 51. Hence, the gear-shaped rotary knife 402 and the blunt blade 412 stay inside the housing of the coupling member 222. The resilient pieces 423 are distorted. The sharp blade 422 is carried by the carriage 22 to move along the tracking bars 21 to have the protruding portion of the sharp blade 422 pass through the paper. Therefore, the paper is cut into two pieces as is desired.

In the carriage, it is preferred that a torsion spring 31 is provided between the knob 223 and the coupling member 222. When the desired cutting action is finished, the rotating force exerted on the knob 223 is released. The recovery force of the torsion spring 31 resulting from the rotation of the knob 223 previously will force the knob 223 to return to its initial position automatically, where none of the three holding elements 401, 411, and 421 are sustained against by respective peak portions of the three sustaining members 50, 51, and 52. While the distorted pairs of the resilient pieces 403, 413 and 423 are lifting the corresponding holding element up, the exposed cutting element is retracted into the housing of the coupling member 222.

In conclusion, by using adjusting means, e.g. the sustaining elements with various thickness, it is not necessary for the user to exert a downwards force onto the carriage to make the cutting element to contact with the paper. Instead, a rotating force is introduced to extrude the desired cutting member from the housing of the coupling member. Further, by interfacing a torsion spring between the knob and the coupling member, no backward rotating force is required to retract the cutting member. Instead, the cutting member can be automatically retracted in response to the removal of the previous rotational force. Therefore, the problem involving friction force while moving the carriage along the rail structure, as encountered in the prior art, can be solved efficiently. Certainly, the arrangement of the sustaining elements on the knob depends on the number and positions of the cutting members, and the number and types of the cutting members are designed according to practical requirements.

While the invention has been described in terms of what is presently considered to be the most practical and preferred embodiments, it is to be understood that the invention needs not be limited to the disclosed embodiment. On the contrary, it is intended to shield various modifications and similar arrangements included within the spirit and scope of the appended claims which are to be accorded with the broadest interpretation so as to encompass all such modifications and similar structures.

What is claimed is:

1. A cutting apparatus for cutting a sheet material, comprising:

a platform for sustaining thereon said sheet material;

a rail structure secured onto said platform;

a sliding member disposed on and movable along said rail structure;

a cutting member movably engaging with and carried by said sliding member to pass through and cut said sheet material sustained on said platform; and an adjusting member urging said cutting member to move relative to said sliding member so as to contact with said sheet material in response to a first external force status and returning said cutting member to move relative to said sliding member so as to release said cut sheet material in response to a second external force status, said adjusting member comprising:

a knob for receiving an external force in either said first external force status or said second external force status; and an elastic member interfacing between said knob and said sliding member for returning said knob to an initial position when there is no external force exerted.

2. The cutting apparatus according to claim 1 wherein said adjusting member comprises:

a sustaining member mounted in said knob and having a relatively thick portion urging said cutting member to move downwards in said first external force status and a relatively thin portion providing a space thereunder for said cutting member to retract in said second external force status.

3. The cutting apparatus according to claim 2 wherein said external force is a rotating force, said first external force status is the exertion of said rotating force in one of clockwise and counterclockwise directions, and the second external force status is the exertion of said rotating force in the other of clockwise and counterclockwise directions.

4. The cutting apparatus according to claim 1 wherein said external force is a rotating force, said first external force status is the exertion of said rotating force, and said second external force status is the release of said rotating force.

5. The cutting apparatus according to claim 4 wherein said elastic member is a torsion spring.

6. The cutting apparatus according to claim 2 wherein said sustaining member comprises a pair of sustaining blocks disposed symmetrically and oppositely, each of said sustaining blocks having an intermediate peak portion and two lateral incline portions.

7. The cutting apparatus according to claim 6 wherein said cutting member comprises:

a rotary knife for completely cutting said sheet material; and a holding element holding said rotary knife and sustained by said intermediate peak portion of said sustaining blocks to move downwards so as to make said rotary knife protrude from a slot of said sliding member in said first external force status.

8. The cutting apparatus according to claim 7 wherein said cutting member further comprises a resilient element engaging with said holding element and sustaining against said sliding member adjacent to said slot, and said resilient element is distorted when said cutting member moves downwards through said slot to contact with said sheet material in response to said first external force status and recovered to push said cutting member to retract into said sliding member in said second external force status.

9. The cutting apparatus according to claim 2 wherein said cutting member comprises three cutting portions arranged in series.

10. The cutting apparatus according to claim 9 wherein said sustaining member comprises:

a first sustaining element located at a first side of said knob, and having a rising incline ending at a first peak in a specific direction;

a second sustaining element disposed at a second side opposite to said first side, and having a falling incline beginning with a second peak in said specific direction; and a third sustaining element consisting of a pair of sustaining blocks symmetrically disposed between said first and second sides, each of said sustaining blocks having an intermediate peak portion and two lateral incline portions;

wherein the positions of said first peak of said first sustaining element, said second peak of said second sustaining element, and said peak portions of said third sustaining element are arranged to respectively sustain said cutting portions of said cutting member at different time points while rotating said knob, thereby pushing essentially one of said cutting portions downwards at one time in response to said first external force status.

11. The cutting apparatus according to claim 9 wherein said cutting portions include:

a first blade having a sharp portion for making said sheet material have a complete cut line while moving cross said sheet material;

a second blade having a gear-shaped blade including sharp teeth at an equidistant interval for making said sheet material have an intermittent cut line while rolling cross said sheet material; and a third blade having a blunt portion for making said sheet material to have a folding line while moving cross said sheet material.

12. A carriage for use with a cutting apparatus for carrying a cutting member to cross over a sheet material, comprising:

a knob having a sustaining member therein for receiving a rotating force;

a coupling member having a slot and cooperating with said knob to define a receptacle for accommodating therein said cutting member; and an elastic member interfacing between said knob and said coupling member for returning said knob to an initial position when said rotating force is released;

wherein said cutting member is urged by said sustaining member to protrude from said slot to contact with said sheet material in response to said rotating force and be retracted into said coupling member when said knob is returned to said initial position.

13. The carriage according to claim 12 wherein said elastic member is a torsion spring.

14. The carriage according to claim 12 wherein said sustaining member comprises a pair of sustaining blocks disposed symmetrically and oppositely, each of said sustaining blocks having an intermediate peak portion and two lateral incline portions.

15. The carriage according to claim 14 wherein said sustaining member further comprises:

a first sustaining element disposed in said knob and adjacent to one side of said sustaining blocks, and having a rising incline ending at a first peak in a specific direction; and a second sustaining element disposed in said knob and adjacent to the other side of said sustaining blocks, and having a falling incline beginning with a second peak in said specific direction.

16. A cutting apparatus for cutting a sheet material, comprising:

a platform for sustaining thereon said sheet material;

a rail structure secured onto said platform;

a sliding member disposed on and movable along said rail structure;

a cutting member movably engaging with and carried by said sliding member to pass through and cut said sheet material sustained on said platform;

a knob cooperating with said sliding member and having a sustaining member therein for receiving a rotating force to rotate from an initial position to a working position, said sustaining member having a relatively thick portion urging said cutting member to move downwards to contact with said sheet material when said knob is at said working position and having a relatively thin portion providing a space thereunder for said cutting member to retract when said knob is at said initial position; and an elastic member interfacing between said knob and said sliding member for returning said knob to said initial position when said rotating force is released.

17. The cutting apparatus according to claim 16 wherein said elastic member is a torsion spring.

18. The cutting apparatus according to claim 16 wherein said sustaining member comprises a pair of sustaining blocks disposed symmetrically and oppositely, each of said sustaining blocks having an intermediate peak portion and two lateral incline portions.

19. The cutting apparatus according to claim 18 wherein said cutting member comprises:

a rotary knife for completely cutting said sheet material;

a holding element holding said rotary knife and sustained by said intermediate peak portion of said sustaining blocks to move downwards so as to make said rotary knife protrude from a slot of said sliding member in response to said rotating force; and a resilient element engaging with said holding element and sustaining against said sliding member adjacent to said slot for pushing said holding element so as to retract said cutting member into said sliding member when said rotating force is released.

* * * * *